United States Patent [19]

Nelson et al.

[11] 4,175,265

[45] Nov. 20, 1979

[54] TONER TRANSFER SYSTEM

[75] Inventors: Alfred M. Nelson, Redondo Beach; David L. Davis, Venice, both of Calif.

[73] Assignee: AM International, Inc., Los Angeles, Calif.

[21] Appl. No.: 736,310

[22] Filed: Oct. 28, 1976

[51] Int. Cl.[2] ..... G03G 19/00

[52] U.S. Cl. ..... 346/74.1; 118/657; 346/153

[58] Field of Search ..... 346/74.1, 153, 155; 118/657, 658, 638

[56] References Cited

U.S. PATENT DOCUMENTS

| | | | |
|---|---|---|---|
| 2,771,505 | 11/1956 | Avery et al. | 346/74.1 |
| 2,932,278 | 4/1960 | Sims, Jr. | 346/74.1 |
| 3,182,591 | 5/1965 | Carlson | 346/153 |
| 3,735,416 | 5/1973 | Ott | 346/74.1 |
| 3,831,178 | 8/1974 | Smith | 346/153 |
| 3,852,525 | 12/1974 | Ichioka | 346/74.1 |
| 3,858,514 | 1/1975 | Beebe | 346/74.1 |
| 3,861,940 | 1/1975 | Forgo et al. | 346/153 |
| 4,025,927 | 5/1977 | Nelson | 346/74.1 |
| 4,030,105 | 6/1977 | Neukevmans | 346/74.1 |
| 4,046,074 | 9/1977 | Hochberg | 346/74.1 |

*Primary Examiner*—Jay P. Lucas

*Attorney, Agent, or Firm*—Robert S. Hulse; Ray S. Pyle

[57] ABSTRACT

Apparatus for printing images on paper or other print medium by transferring toner on a magnetic tape onto the paper, using a voltage pulse applied between electrodes located respectively behind the tape and behind the paper. The electrode behind the tape is narrower than the tape, so that the opposite edge portions of the tape serve as insulators that prevent the formation of electric arcs between the electrodes. The voltage is applied in the form of a high voltage pulse on the order of 1500 volts lasting on the order of one millisecond, to transfer toner, and is followed by a sustained voltage on the order of 150 volts for preventing the toner particles from shifting position on the paper.

9 Claims, 4 Drawing Figures

TONER TRANSFER SYSTEM

BACKGROUND OF THE INVENTION

One printing system, described in U.S. Pat. Application Ser. No. 631,329, filed Nov. 12, 1975 by Alfred M. Nelson now abandoned, includes a recording head for recording magnetic images on the front face of a magnetic tape. The system also includes apparatus for coating the images with toner, and a transfer station which transfers the toner from the tape to paper or other print medium to form an image on the paper corresponding to the characters formed on the tape. At the transfer station of that system, the tape and paper are held a small distance apart, such as one hundredth inch, while a high voltage is applied between electrodes positioned respectively behind the tape and paper. One problem with the system is that arcing can occur between the electrodes when a high voltage is applied to them, since they are so close together. Another problem is that the toner particles on the paper tend to produce a "halo" effect, wherein a band of toner particles lies about the intended images, or at least about heavily toned regions of the image. Another problem is that it is difficult to maintain the tape and paper a small but accurate distance apart.

SUMMARY OF THE INVENTION in accordance with one embodiment of the present invention, a transfer station apparatus is provided which enables transfer of toner from a tape or other record onto paper or other print medium, so as to provide a high quality of printed image on the print medium.

The transfer apparatus includes a pair of electrodes, one behind the tape or other record and the other behind the paper or other print medium, and a voltage supply which produces a high voltage transfer pulse between the electrodes to produce an electric field that causes tone transfer from the tape to the paper. In order to prevent arcing, a tape is utilized which includes a base of dielectric material, and the electrode behind the tape is narrower than the tape. Accordingly, the opposite edge portions of the tape serve as an insulative cover that prevents arcing between the electrodes.

In order to prevent the toner particles from slightly shifting position to produce a "halo" effect which degrades the image on the paper, a retention voltage is maintained between the electrodes following the brief high voltage transfer pulse. The retention voltage is of much lower magnitude than the brief transfer pulse, but is of longer duration.

The novel features of the invention are set forth with particularity in the appended claims. The invention will be best understood from the following description when read in conjunction with the accompanying drawings.

DESCRIPTION OF PREFERRED EMBODIMENTS

Figure 1:
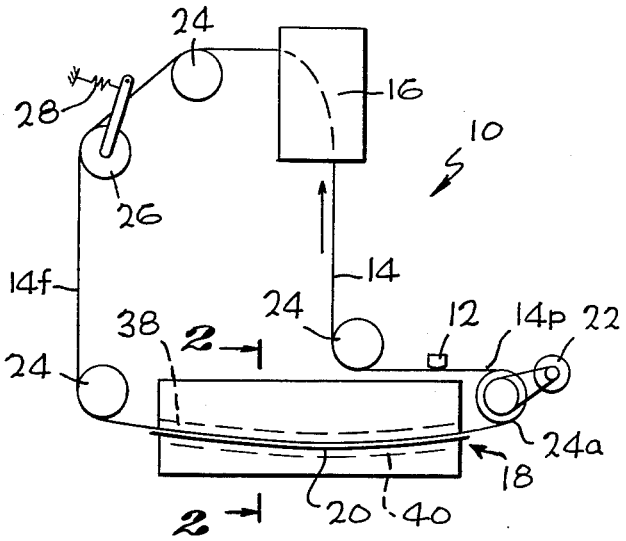
FIG. 1 is a simplified side elevation view of a printer apparatus constructed in accordance with the invention.

FIG. 1 illustrates a printing system 10 which includes a recording head 12 that records magnetic images on a magnetic tape record or tape 14. The tape moves along a tape path **14*p* that extends through a toner applying apparatus 16 where toner is applied to the magnetic images recorded on the tape, and through a transfer station 18 where toner is transferred from a front face 14*f* of the tape to a paper 20 or other print medium. After each group of perhaps 100 characters is recorded by the head 12 on the tape and the images are coated with toner, the group of toned images is transferred at the station 18 to the group of toned images is transferred at the station 18 to the paper 20 to form a line of characters thereon. The paper i.e., transverse to the tape is then advanced (in a direction out of the paper as seen in FIG. 1) so that a new line of characters can be printed thereon. The tape 14 extends in an endless loop, is driven thereabout by a motor 22 coupled to a roller 24*a*, is guided about the loop by several other rollers 24, and is maintained under tension by a tensioning roller 26 which is biased by a spring 28**.

Figure 2:
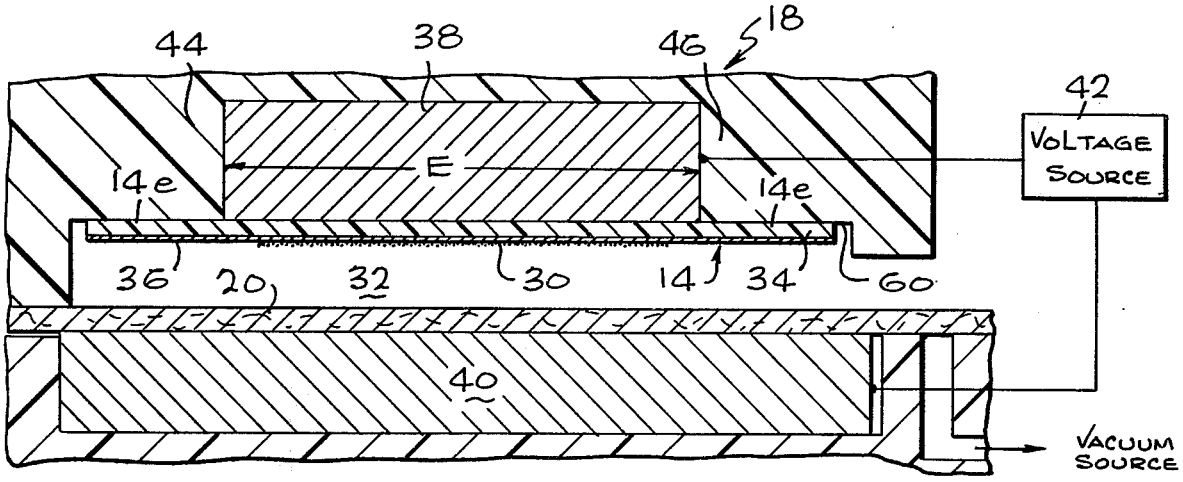
FIG. 2 is an enlarged view taken on the line 2—2 of FIG. 1.

FIG. 2 illustrates details of the transfer station 18 where toner 30 on the tape 14 is transferred across an air gap 32 to the paper 20 or other print medium. It may be noted that instead of maintaining an air gap between the tape and print medium during toner transfer, it is possible to bring them together. Bringing the tape and print medium together at the time of toner transfer requires that the tape stop moving for a short period, which increases the cost and complexity of the system, However, bringing the tape and print medium together can reduce the quantity of stray toner particles which produce a "dirty" background on the print medium.

It can be seen in FIG. 2 that the tape 14 includes a layer or base 34 of dielectric material such as Mylar, and a layer 36 of nonmetalic magnetizable material such as chromium dioxide lying on the base. Toner is transferred from the tape to the paper by an electric field produced by applying a voltage to a pair of electrodes 38, 40. The electrodes 38, 40, lie respectively behind the tape 14 and behind the paper 20, so that the tape and paper are sandwiched between the electrodes. A voltage source 42 is connected between the two electrodes 38, 40 to apply a high voltage pulse, of a magnitude such as 1200 to 1800 volts, between the electrodes which establishes an electric field through the gap 32 to cause toner transfer across the gap. The transfer pulse preferably has a short duration on the order of a millisecond. The transfer pulse should have a duration of at least 0.10 milliseconds to transfer appreciable toner, 0.25 milliseconds to transfer most of the toner, and 1 to 2 milliseconds to transfer substantially all toner. At a transfer pulse period much above 2 milliseconds, the transferred toner begins to spread and therefore the characters become fuzzy.

The air gap 32 is relatively small, such as 4 to 5 mil (thousandths of an inch), while the paper 20 may have a thickness such as three mil and the tape 14 may have a thickness such as two mil. As a result, the electrodes 38, 40 are close together and a high intensity electric field id established between them. Such a high intensity field can produce arcing, which is the production of a spark between the electrodes. To prevent arcing, the electrode 38 which lies behind the tape, is constructed with a width E which is less than the width of the tape 14. As a result, edge portions 14*e* of the tape extend beyond either edge of the electrode 38. In addition, a pair of insulators 44, 46 are provided on either side of the tape. The insulators 44, 46 and the edge portions 14*e* of the tape serve to provide insulation around the electrode 38, to prevent the creation of arcs between the electrode 38 and the other electrode 40.

It has been found that when toner representing an image such as the letter "C", is transferred across the air gap 32 to the paper, 20, a "halo" effect occurs, especially at heavily toned areas of the image. The halo effect is an effect whereby a band of toner appears around the intended image, particularly at heavily toned areas of the image, the band being spaced slightly away from the toned image area. This halo effect tends to degrade the sharpness of the image. In accordance with the present invention, it has been found that when a voltage is applied between the electrodes, which is of the same polarity as the high voltage pulse which transferred the toner across the air gap, but which is of much lower magnitude, the halo effect does not occur. In equipment of the type described above wherein a transfer pulse of 1200 to 1800 volts was utilized to transfer toner across the air gap, it was found that a retaining voltage of about 150 volts eliminated the halo effect. It may be noted that a magnetic tape with a metallic magnetic layer can be utilized, instead of one with an oxide magnetic layer, and in that case the metallic tape layer can serve as an electrode which lies behind the toner.

Figure 4:
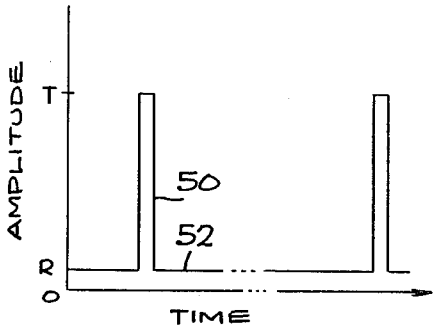
FIG. 4 is a graph showing the voltage applied between the electrodes of FIG. 2.

FIG. 4 illustrates the manner in which the retaining voltage has been applied between the electrodes to prevent a halo effect. In the figure, a transfer pulse 50 is shown which was applied for a duration of approximately one millisecond. Each transfer pulse is immediately followed by a retaining voltage 52 of an amplitude R on the order of magnitude of one tenth the amplitude of the transfer pulse of amplitude T. If the magnitude of the retaining voltage 52 is reduced from the optimum level, the halo effect begins to appear. A retaining voltage much above the level indicated above can tend to cause premature toner transfer across the air gap. The retaining voltage is desirable even when the tape and print medium are brought together prior to toner transfer to prevent appearance of the halo effect after the tape and print medium are separated.

Figure 3:
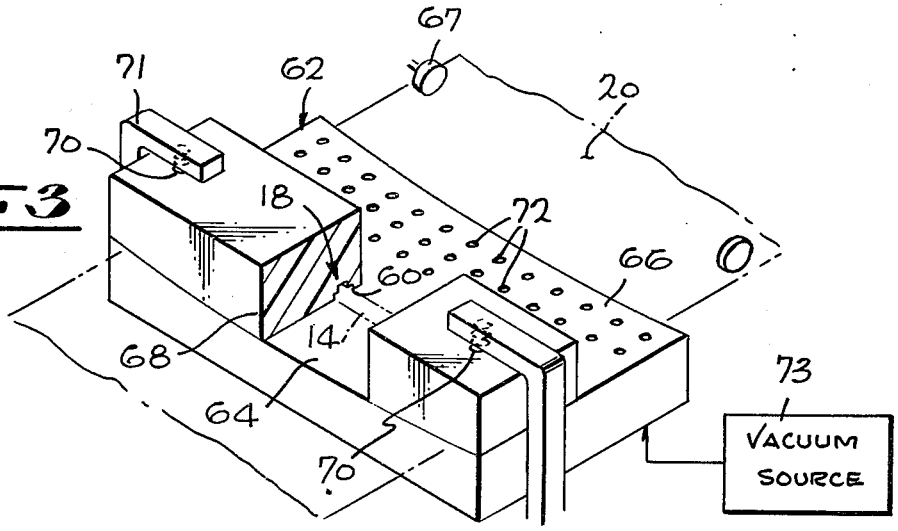
FIG. 3 is a perspective view of a portion of the apparatus of FIG. 1.

In order to maintain the tape 14 and paper 20 a small distance apart such as five mil, across almost the entire width of the paper 20, which typically has a width of eight one-half inches, guides are provided for accurately positioning the tape and paper. The guide surface 60 for the tape is convexly curved, and the tape is held under tension, so that the tape is held in an accurately controlled convex configuration. The paper 20 is held in a concave configuration against a guide 62 which is best shown in FIG. 3. The paper guide has an up-path end 64 which is located along the path of the paper print medium at a location up-path from the transfer station 18, the guide also having a downpath end 66 located downpath from the transfer station. The guide 62 is concavely curved about an axis extending parallel to the print medium path so that the guide would appear concave as seen in an imaginary sectional view taken perpendicular to the print medium path. The paper is moved by motor-driven rollers 67.

A rigid convex print medium guide member 68 is provided which bears against the up-path end 64 of the guide to maintain the paper in a concave configuration as it approaches the transfer station. A pair of springs 70 supported on frame members 71, urge the guide member 68 downwardly againt the paper. The downpath end 66 of the guide has numerous vacuum holes 72 which are coupled to a vacuum source 73 for applying a vacuum to the back face of the paper to hold it against the guide. By thus accurately positioning the paper against the concave guide 62, the paper is accurately configured so that a substantially constant air gap 32 is produced between the tape and paper. It may be noted that the convex guide member 68 extends a distance of at least one inch along the paper path so that it rests stably against the paper without cocking to one side. It is possible to use a vacuum at the up-path end 64 of the concave guide to hold down the paper thereat. However, vacuum normally cannot be applied directly opposite the tape 14, because the vacuum often can draw in air through the paper, and this air flow can prematurely draw toner particles from the tape onto the paper to dirty it.

Thus, the invention provides apparatus and methods for effectively transferring toner from a record such as tape to a print medium such as paper. Arcing caused by the high voltages utilized to effect toner transfer, is prevented by utilizing a tape or other record of dielectric material and by utilizing an electrode behind the tape which is narrower than the tape and positioned so that edge portions of the tape lie on either side of the electrode. Spreading of the toner particles to produce a "halo" effect is prevented by applying a retaining voltage much less than the transfer voltage, but which is applied to the electrodes following the application of the of the transfer pulse. Where an air gap is utilized across which toner much move, maintenance of an accurately controlled air gap is accomplished by holding down the paper to a concave guide at locations both up-path and downpath from the transfer station location which is opposite the tape, utilizing a hold-down means up-path from the transfer station which extends at least an inch therealong to preform the paper into a concave curve.

Although particular embodiments of the invention have been described and illustrated herein, it is recognized that modifications and variations may readily occur to those skilled in the art and consequently it is intended that the claims be interpreted to cove such modifications and equivalents.

What is claimed is:

1. In a printing system which includes a tape transport for moving a tape which has a layer of dielectric material and which has front and rear faces, with the front face carrying toner that forms images thereon, along a predetermined tape path, a print medium transport for moving paper or other print medium along a predetermined print medium path that passes adjacent to said tape path, so that the front of the tape faces the front of the print medium, and a transfer station located at the region where said print medium path moves the adjacent to said tape path, the improvement of a toner transfer apparatus comprising:

a transfer electrode located behind said tape path, at said transfer station, a reference electrode located behind said print medium path at said transfer station;

a voltage source coupled to said electrodes, for applying a voltage between said electrodes that causes the toner on said tape to transfer from said tape to said print medium;

said transfer electrode being narrower than said tape; and a pair of insulator portions located on either side of said transfer electrode and behind opposite side portions of said tape, whereby to prevent arcing when a high voltage is applied.

2. Printing apparatus comprising:

a record having a magnetic image;

means for applying toner to the image area of said record;

means for moving a print medium along a print medium path;

guide means for holding said record and a print medium which extends along said print medium path, so that they lie facewise adjacent to one another; and means for applying an electric field between said record and print medium that transfers toner from said record to the print medium, including a first electrode positioned behind said record and a second electrode positioned behind said print medium, so that said record and print medium lie between said electrodes, and including a source for applying a high voltage between said electrodes;

said record including a layer of dielectric material, and said first electrode being narrower than said record and positioned so that side portions of said record lie beyond the extreme sides of said electrode, whereby to prevent arcing.

3. In a printing system which includes a tape transport for moving a tape containing toner that forms images thereon, along a predetermined tape path, and a print medium transport for moving paper or other print medium along a predetermined print medium path that passes adjacent to said tape path, said print medium path passing adjacent to said tape path, at a transfer station where the front of the tape faces the front of the print medium, the improvement of a toner transfer apparatus comprising:

a first electrode located behind said tape path;

a second electrode located behind said print medium path;

means for holding said tape and print medium adjacent to one another at said transfer location; and voltage means for applying a high voltage pulse between said electrodes, to cause the toner on said tape to transfer from said tape to said print medium, followed by a retaining voltage of a magnitude of less than one-half the magnitude of said transfer pulse and of longer duration than said transfer pulse, to help prevent movement of the transferred toner particles.

4. The improvement described in claim 3 wherein:

said transfer pulse has an amplitude on the order of magnitude of 1,500 volts while said retaining voltage has an amplitude on the order of magnitude of 150 volts.

5. Printing apparatus for printing on a print medium, comprising:

a record;

means for forming a magnetic image on said record;

means for applying toner to the image area of said record;

means for moving a print medium along a print medium path;

means for holding said record and a print medium which extends along said print medium path, so that they face one another at a predetermined transfer location; and means for applying an electric field at said transfer location that transfers toner from said record to the print medium;

said means for applying a field including a pair of electrode means positioned so that toner on said record and said print medium lie between said electrode means, and a source for applying a transfer pulse of an amplitude on the order of magnitude of 1500 volts and a duration on the order of magnitude of 1 millisecond between said electride means, and for then applying a retaining voltage of an amplitude on the order of magnitude of 150 volts between said electrode means.

6. Printing apparatus comprising:

a tape;

means for forming magnetic image on said tape;

means for applying toner tothe image area of said tape;

means for moving a print medium along a print medium path;

means for moving said tape across said print medium path;

means for holding said tape and a print medium which extends along said print medium path, so that they are spaced a small distance apart at a predetemined transfer location, to leave a small gap between them; and means for applying a field across said gap that moves toner from said tape to the print medium;

said holding means including a concave print medium guide which is concave as seen in an imaginary sectional view taken perpendicular to the length of print medium path, along a region which extends both up-path and down-path from said transfer location, and a convex tape support extending across said print medium path;

said hold means also including a rigid convex support lying immediately up-path from said transfer location and biased against a print medium on said concave guide to closely control bending of said print medium;

said concave support having a hold-down region lying immediately up-path from said transfer location, said hold-down region having a plurality of vacuum-applying holes; and including a vacuum source coupled to said vacuum-applying holes, whereby to accurately bend the print medium before and after it reaches the transfer location to maintain an accurate and uniform gap at the transfer location.

7. A method for printing on a print medium, comprising:

recording magnetic images on a magnetizable record which has a base of dielectric material;

applying toner particles to magnetic images on said record;

positioning said record at a location adjacent to and facing the print medium;

maintaining a first electrode means behind the toner on said record, so that the toner lies between the first electrode and the print medium;

maintaining a second electrode means on a rearward side of said print medium, which is opposite said record; and applying a voltage between said electrode means, including applying a brief transfer pulse of a magnitude which causes substantially all toner particles to transfer from the record to the print medium, and then maintaining a retaining voltage of less than said transfer pulse between said electrode means.

8. The method described in claim 7 wherein:

said step of applying a transfer pulse includes applying a voltage on the order of magnitude of 1500 volts for a period on the order of magnitude of one millisecond, and said step of maintaining a retaining voltage includes maintaining a voltage on the order of magnitude of 150 volts.

9. A method for printing on a print medium, comprising:

recording magnetic images on a magnetizable record;

applying toner to image areas on said record;

maintaining a middle portion of a concave print medium guide, which has opposite end portions, a small distance from said record at said transfer location, so that different portions of said guide lie up-path and down-path from said transfer location along a predetermmined print medium path;

maintaining a convex print medium guide member, which is curved complementary to said concave print medium guide, at a location immediately up-path from said transfer location;

moving said print medium along said print medium path, between said concave guide and convex guide member, past said transfer location, and along the downpath portion of said concave guide which lies downpath from said transfer location;

transferring toner from said record to portions of said print medium at said transfer location; and applying a vacuum through said downpath portions of said guide, to hold said print medium thereagainst.

* * * * *